US011311155B2

(12) United States Patent
Diethelm et al.

(10) Patent No.: US 11,311,155 B2
(45) Date of Patent: Apr. 26, 2022

(54) CONNECTION DEVICE FOR A TOILET BOWL

(71) Applicant: GEBERIT INTERNATIONAL AG, Jona (CH)

(72) Inventors: Alois Diethelm, Vorderthal (CH); Juanes Braulio, Wetzikon (CH); Martin Niederberger, Uznach (CH); Rolf Weiss, Grüningen (CH); Maurus Zwicker, Eschenbach (CH)

(73) Assignee: GEBERIT INTERNATIONAL AG, Jona (CH)

( * ) Notice: Subject to any disclaimer, the term of this patent is extended or adjusted under 35 U.S.C. 154(b) by 60 days.

(21) Appl. No.: 16/965,535

(22) PCT Filed: Jan. 29, 2019

(86) PCT No.: PCT/EP2019/052130

§ 371 (c)(1),
(2) Date: Jul. 28, 2020

(87) PCT Pub. No.: WO2019/145568

PCT Pub. Date: Aug. 1, 2019

(65) Prior Publication Data

US 2021/0047821 A1 Feb. 18, 2021

(30) Foreign Application Priority Data

Jan. 29, 2018 (EP) ..... 18153793
Jan. 29, 2018 (EP) ..... 18153795
(Continued)

(51) Int. Cl.
*E03D 11/14* (2006.01)
*A47K 13/12* (2006.01)
(Continued)

(52) U.S. Cl.
CPC ..... *A47K 13/12* (2013.01); *E03C 1/322* (2013.01); *E03C 1/324* (2013.01); *E03D 11/125* (2013.01);
(Continued)

(58) Field of Classification Search
CPC . E03C 1/32; E03C 1/322; E03C 1/324; E03D 11/125; E03D 11/14; E03D 11/17; E03D 11/143
(Continued)

(56) References Cited

U.S. PATENT DOCUMENTS 4,091,473 A 5/1978 Matthews et al.
8,141,177 B1 * 3/2012 Majocka ..... E03D 11/14 4/252.3
(Continued)

FOREIGN PATENT DOCUMENTS

CN 1111313 A 11/1995
CN 201356507 Y 12/2009
(Continued)

OTHER PUBLICATIONS

International Search Report for PCT/EP2019/052130 dated Apr. 24, 2019 [PC/ISA/210].
(Continued)

*Primary Examiner* — Huyen D Le
(74) *Attorney, Agent, or Firm* — Sughrue Mion, PLLC

(57) ABSTRACT

A connection device for a toilet bowl, comprising a carrier arrangement which can be connected to the toilet bowl in a displaceable manner. The device has a first bearing point in which a flushing pipe is mounted, and a second bearing point in which an outflow pipe is mounted. The flushing pipe can be connected to a flushing water line which is arranged in a positionally fixed manner on site The outflow pipe can be connected to a waste water line which is arranged in a
(Continued)

positionally fixed manner on site, and can be connected to a waste water outflow which is arranged on the toilet bowl side.

18 Claims, 9 Drawing Sheets

(30) Foreign Application Priority Data

Jan. 29, 2018 (EP) ..... 18153796
Jan. 29, 2018 (EP) ..... 18153797

(51) Int. Cl.
*E03D 11/12* (2006.01)
*E03D 11/16* (2006.01)
*E03D 11/17* (2006.01)
*E03C 1/324* (2006.01)
*E03C 1/322* (2006.01)

(52) U.S. Cl.
CPC ..... *E03D 11/143* (2013.01); *E03D 11/16* (2013.01); *E03D 11/17* (2013.01)

(58) Field of Classification Search
USPC ..... 4/252.1
See application file for complete search history.

(56) References Cited

U.S. PATENT DOCUMENTS

2004/0133969 A1* 7/2004 Akin ..... E03D 11/14 4/252.2
2021/0285200 A1* 9/2021 Ravenscroft ..... E03D 11/12

FOREIGN PATENT DOCUMENTS

| | | | |
|---|---|---|---|
| CN | 101918650 | A | 12/2010 |
| CN | 103221619 | A | 7/2013 |
| CN | 104641047 | A | 5/2015 |
| DE | 202 03 71 | U1 | 6/2002 |
| DE | 20203871 | U1 | 6/2002 |
| DE | 20 2007 011 892 | U1 | 1/2008 |
| DE | 10 2006 045 767 | A1 | 4/2008 |
| JP | H10-121554 | A | 5/1998 |
| WO | 2018/055415 | A1 | 3/2018 |

OTHER PUBLICATIONS

Written Opinion for PCT/EP2019/052130 dated Apr. 24, 2019 [PC/ISA/237].
Search Report dated Jan. 24, 2021 from the China National Intellectual Property Administration in CN Application No. 201980010327.8.

* cited by examiner

CONNECTION DEVICE FOR A TOILET BOWL

CROSS REFERENCE TO RELATED APPLICATIONS

This application is a National Stage of International Application No. PCT/EP2019/052130 filed Jan. 29, 2019, claiming priority based on European Patent Application No. 18153793.7 filed Jan. 29, 2018, European Patent Application No. 18153796.0 filed Jan. 29, 2018, European Patent Application No. 18153795.2 filed Jan. 29, 2018 and European Patent Application No. 18153797.8 filed Jan. 29, 2018.

TECHNICAL FIELD

The present invention relates to a connection device for a toilet bowl according to the preamble of claim 1.

PRIOR ART

Connection devices for toilet bowls are known from the prior art. For example, WO 2010/143965 and WO 2017/063095 disclose corresponding devices.

The assembly height of toilet bowls can vary for various reasons. For example, owing to the thickness of the floor structure in a bathroom, which cannot be directly predicted, or owing to the desires of the future user of the toilet.

Typically, the height of the wall connections, namely of the flushing water supply, of the outflow and of the fastening elements, is fixedly predefined on site. Further, the flushing water inflow and the waste water outflow are also fixedly predefined on the toilet side. There is thus a predefined connection structure on site and a predefined expulsion structure of the toilet bowl, which structures need to be connected to one another. During an adjustment of the height position of the toilet bowl, an offset arises between these two connection structures.

SUMMARY OF THE INVENTION

Proceeding from said prior art, the present invention is based on an object of specifying a connection device for a toilet bowl, which makes it possible to compensate for the offset during an adjustment of the height position of the toilet bowl in a simple manner.

Said object is achieved by the subject matter as claimed in claim 1. Accordingly, a connection device for a toilet bowl comprises a carrier arrangement which can be connected to the toilet bowl in a displaceable manner, having a first bearing point in which a flushing pipe is mounted, and having a second bearing point in which an outflow pipe is mounted, which flushing pipe can be connected to a flushing water line which is arranged in a positionally fixed manner on site, and can be connected to a flushing water inflow which is fixedly arranged on the toilet bowl side, and which outflow pipe can be connected to a waste water line which is arranged in a positionally fixed manner on site, and can be connected to a waste water outflow which is fixedly arranged on the toilet bowl side. The axial distance between the center axis of the flushing pipe and the center axis of the outflow pipe is fixed in the carrier arrangement. The carrier arrangement and the toilet bowl, during the adjustment of the height position of the toilet bowl, can be displaced relative to one another in the direction of an adjustment movement. The flushing pipe and the outflow pipe each have at least one compensation portion. An adjustment offset, which results during the adjustment movement between the carrier arrangement and the toilet bowl, can be compensated with the compensation portion. The adjustment offset can be compensated between the flushing pipe which is mounted in the carrier arrangement and the outflow pipe which is mounted in the carrier arrangement and the flushing water inflow and waste water outflow, respectively, which are arranged on the toilet bowl side, and/or can be compensated between the flushing water line which is arranged in a positionally fixed manner on site and the waste water line which is arranged in a positionally fixed manner on site and the flushing water inflow and waste water outflow, respectively, which are arranged on the toilet bowl side.

The fixed arrangement of the flushing pipe and outflow pipe on the carrier arrangement, which is arranged displaceably with respect to the toilet bowl, and the compensation portion create an arrangement with which the adjustment offset during the assembly operation can be compensated in a simple manner. The toilet bowl is in this case preferably displaced relative to the stationary carrier arrangement, with the adjustment offset which arises as a result being compensated by the compensation portions. The carrier arrangement is connected by way of the flushing pipe and the outflow pipe to the lines which are arranged in a positionally fixed manner on site, and thus is likewise positionally fixed.

Preferably, the axial distance between the two bearing points is greater than the axial distance between the flushing water inflow which is arranged on the toilet side and the waste water outflow which is arranged on the toilet side. The difference between the two axial distances preferably corresponds to the maximum adjustment offset. The formation of the corresponding axial distances has the advantage that, in extreme positions, neither an area of water accumulation in the flushing water inflow nor increased siphoning in the waste water outflow arises.

The resulting adjustment offset is an adjustment offset which runs in the vertical. The toilet bowl can be displaced substantially in the vertical with respect to the carrier arrangement.

The wording "can be connected in a displaceable manner" in relation to the connection between the toilet bowl and the carrier arrangement is understood as meaning that the connection is such that the toilet bowl and the carrier arrangement are connected to one another, with the connection permitting the two elements to be displaced relative to one another.

The term "compensation portion" is understood to mean a portion in the flushing pipe and in the outflow pipe, respectively, which is configured in such a way that the adjustment offset can be compensated. The adjustment offset can take place as a result of a deformation of the compensation portion and/or as a result of a change in the position of the compensation portion.

Preferably, the compensation portion is configured in such a way that the losses in terms of flow which arise as a result of a change in the compensation portion are as low as possible.

The wording "fixedly connected" in conjunction with the arrangement of the bearing element in the receiving space of the toilet bowl is understood as meaning that the bearing element can be connected fixedly, that is to say substantially non-displaceably, in the receiving space to the toilet bowl. The connection is in this case such that a force acting on the toilet bowl is transmitted onto the bearing element. The bearing element can be inserted into the receiving space and can be braced with the toilet bowl.

The wording "positionally fixed" is understood as meaning that positionally fixedly arranged elements are arranged in situ such that they cannot be displaced, that is to say fixedly.

The two bearing points lie at a fixed and determined distance with respect to one another. In this way, it is ensured that the flushing pipe and the outflow pipe lie at a matching position with respect to the lines which lie on site.

Preferably, the carrier arrangement can be arranged within a receiving space of the toilet bowl. That is to say that the carrier arrangement is configured in such a way that the carrier arrangement is arranged in the interior of a toilet bowl.

Preferably, the at least one compensation portion lies within the receiving space of the toilet bowl. This has the advantage that the compensation portion is well protected against external influences, and that the connection device can be of compact configuration.

Particularly preferably, the compensation portion lies in each case between the carrier arrangement and the flushing water inflow and the waste water outflow, respectively, of the toilet bowl. The end of the flushing pipe and of the outflow pipe then advantageously lies in each case in the region of the bearing point, the on-site flushing water line and waste water line, respectively, being connected in the region of the bearing point.

Preferably, the compensation portion in the flushing pipe and/or in the outflow pipe is provided by a deflecting portion in the respective pipe and by a pivotable mounting of the respective pipe in the bearing point, wherein, during the height adjustment, the respective pipe is pivoted in the bearing point. On account of the deflecting portion and the pivoting movement, an offset of the pipe region which lies outside of the bearing point is achieved. As a result of the deflecting portion, an axial offset results in the flushing pipe, with which axial offset the position of the flushing pipe and of the outflow pipe, respectively, in the region of the opening into the flushing water inflow and the waste water outflow, respectively, can then be adapted to the adjustment offset.

In other words, a type of "eccentric" is created in the region of the flushing pipe, with which eccentric the adjustment offset can be compensated.

Particularly preferably, the flushing pipe is configured with the deflecting portion. The flushing pipe then comprises a bearing portion, the deflecting portion and a mouth portion. The bearing portion lies pivotably in the bearing point and can be connected to the flushing water line. The mouth portion opens into the flushing water inflow and lies, on account of the arrangement of the deflecting portion, offset from the bearing portion. That is to say that the center axis of the bearing portion runs parallel to, and spaced apart from, the center axis of the mouth portion.

Preferably, the pipe is configured with the deflecting portion in a substantially rigid or practically rigid manner. That is to say that the compensation portion and also the other portions of the pipe do not deform, or deform only to an insignificant extent, during the adjustment movement. This has the advantage that the flow conditions are always the same and are independent of the height position of the toilet bowl.

The wording "substantially rigid or practically rigid" is preferably understood as meaning that the deflecting portion is configured to be rigid to the extent that it can still be deformed slightly.

Particularly preferably, in the region of the inlet into the flushing water inflow and into the waste water outflow, respectively, the flushing pipe and the outflow pipe, respectively, are mounted with a seal in the flushing water inflow and in the waste water outflow, respectively. The seal is configured in such a way that a displacement of the respective pipe transversely with respect to the center axis of the flushing water inflow and of the waste water outflow, respectively, can be accommodated. The displacement results substantially from the above-described pivoting movement about the center axis of the respective pipe in the bearing point.

Particularly preferably, the seal is provided on the outside with a plurality of mutually spaced-apart elastic sealing lips. The sealing lips are in this case of very flexible configuration, which is advantageous for compensating for the aforementioned displacement.

In another embodiment, the compensation portion in the outflow pipe and/or in the flushing pipe is a flexibly deformable pipe portion, which flexible deformable pipe portion is preferably a corrugated bellows or a rubber bellows. The flexible deformable pipe portion can in this case be part of the outflow pipe and of the flushing pipe, respectively; or the flexible deformable pipe portion can provide the outflow pipe or the flushing pipe.

In a particularly preferred embodiment, the flushing pipe is configured with the deflecting portion and the outflow pipe is configured with the flexibly or elastically deformable pipe portion. This has the advantage that, in the case of the flushing pipe, as described above, low flow losses arise, which is important for the introduction of the water into the toilet bowl, whereas, in the case of the outflow pipe, possible flow losses are less significant as a result of the deformation of the. In this respect, each of the two pipes can be assigned the optimum property provided that there is a corresponding deformation for compensating for the adjustment offset.

The carrier arrangement is preferably fixedly fastened to fastening means which are assembled on site. Particularly preferably, the carrier arrangement has at least one fastening receptacle. Particularly preferably, two fastening receptacles are arranged. A threaded element can be placed in the fastening receptacle, wherein the threaded element can be brought into engagement with a threaded rod which is assembled on site. In this case, the threaded rod represents said fastening means which is assembled on site.

Preferably, the threaded element is arranged in such a way that the latter can be actuated through an access opening in the toilet bowl.

However, as an alternative, the toilet bowl can also be fixedly fastened to fastening means which are assembled on site.

Particularly preferably, the carrier arrangement comprises a first carrier part and a second carrier part which can be connected to the first carrier part. The two-part design of the carrier arrangement has the advantage that the assembly of the carrier arrangement in the receiving space, in particular the connection to the already assembled bearing element, is made simpler. The spatial conditions in the receiving space are typically confined, as a result of which the ease of assembly is increased with the two-part design.

Particularly preferably, the bearing point for the flushing pipe is provided by the first carrier part and the second carrier part. It is further preferred for the bearing point for the outflow pipe to be arranged on the second carrier part, with the outflow pipe preferably being fixedly connected to the bearing point.

Preferably, the connection device furthermore comprises a bearing element. The carrier arrangement is connected to the toilet bowl by way of the bearing element. The bearing element can be configured in various ways:

The bearing element according to a first variant is fixedly connected to the toilet bowl, with the bearing element preferably being fixedly connected in the receiving space to the toilet bowl.

The bearing element according to a second variant is fixedly integrated on the toilet bowl.

The bearing element according to a third variant is provided by the toilet bowl.

In all three variants, the carrier arrangement is movably connected to the bearing element, and specifically in such a way that the said adjustment movement can be executed.

Preferably, the carrier arrangement and the bearing element are connected to one another by way of at least one longitudinal guide, wherein the at least one longitudinal guide is oriented in the vertical in the installation position. Preferably, two spaced-apart longitudinal guides are arranged on the bearing element, into which guides the carrier arrangement engages.

Preferably, as seen from the access opening of the receiving space into the receiving space, the first carrier part is arranged substantially downstream of the bearing element and the second carrier part is arranged substantially upstream of the bearing element. In this way, the tight spatial conditions can be optimally utilized, with the bearing element being well placed for absorbing high forces.

The second carrier part is preferably arranged below the first carrier part and thus supports the first carrier part.

Preferably, after adjustment of the height position has been completed, the carrier arrangement can be fixed to the bearing element, or can be connected to the bearing element, in a positively locking and/or force-fitting and/or frictionally locking manner.

Said fastening receptacle which is present on the carrier arrangement is preferably arranged on the first carrier part and on the second carrier part. Particularly preferably, the fastening receptacle penetrates the bearing element at least partially.

The at least one fastening receptacle lies at a fixed and determined distance with respect to the two bearing points. In this way, it is ensured that the elements of the carrier arrangement, which are connected to the on-site elements, lie in a matching manner with respect to the on-site elements.

Preferably, the bearing element has a crossmember portion and two mutually spaced-apart support portions which project away from the crossmember portion, wherein the support portions, in the region of their free end, each have a clamping element, with which the bearing element can be braced in the receiving space.

The flushing pipe and the outflow pipe lie in the intermediate space between the two support portions and penetrate said intermediate space.

Preferably, the support portions in each case have the at least one longitudinal guide in which the carrier arrangement is mounted on the bearing element in a movable manner, wherein, after adjustment has been completed, the carrier arrangement can be fixed, or can be connected, to the support portions in a positively locking and/or force-fitting and/or frictionally locking manner.

Preferably, the carrier arrangement engages into the longitudinal guide and can be displaced along the longitudinal guide relative to the support portion. The longitudinal guide is preferably a cutout in the support portion, which cutout correspondingly penetrates the support portion such that the carrier arrangement can engage, from both sides of the bearing element, into the longitudinal guide.

Preferably, the longitudinal guide has mutually spaced-apart latching openings into which a latching element which is arranged on the carrier arrangement can engage in a positively locking manner. The distances between the latching openings are preferably in the range of 5 to 15 millimeters, such that a correspondingly fine gradation can be provided.

Preferably, the adjustment movement is approximately 50 millimeters.

Preferably, the relative position between the carrier arrangement and the bearing element, which is fixedly connected to the toilet bowl, is adjusted prior to the assembly of the carrier arrangement on the fastening means which are assembled on site. Subsequently, the carrier arrangement is then fixedly connected to the fastening means which are assembled on site, and the flushing pipe and the outflow pipe are connected to the flushing water line and the waste water line.

As an alternative, the carrier arrangement is connected to the fastening means arranged on site prior to the adjustment movement, with the toilet bowl then being displaced together with the bearing element for the adjustment of the height position of the toilet bowl. After adjustment has been completed, the carrier arrangement is fixedly connected to the fastening means arranged on site.

An arrangement comprises a connection device according to the description above and a toilet bowl having a receiving space, a flushing water inflow and a waste water outflow, with the connection device preferably being arranged in the receiving space.

A method for assembling a connection device according to the description above is characterized in that, in a first step, the carrier arrangement is connected to the toilet bowl, wherein the flushing pipe is connected to the flushing water inflow and the outflow pipe is connected to the waste water outflow;

in that, in a second step, the toilet bowl z is displaced relative to the carrier arrangement, such that the height of the toilet bowl can be adjusted, wherein, in this way, the compensation portions, in accordance with the height position, compensate for the adjustment offset, which results during the adjustment movement between the carrier arrangement and the toilet bowl, between the flushing pipe which is mounted in the carrier arrangement and the outflow pipe which is mounted in the carrier arrangement and the flushing water inflow and waste water outflow, respectively, which are arranged on the toilet bowl side, and/or between the flushing water line and waste water line, respectively, which are arranged in a positionally fixed manner on site and the flushing water inflow and waste water outflow, respectively, which are arranged on the toilet bowl side, and in that, in a third step, the carrier arrangement is oriented with respect to, and connected to, the on-site flushing water line, the on-site waste water line and the on-site fastening element.

The steps are carried out in succession in accordance with the described order. However, it is also conceivable for the third step to be carried out prior to the second step.

Said adjustment offset is compensated with the compensation element.

If the bearing element is present, in the first step, the carrier arrangement is connected to the toilet bowl by way of the bearing element. If the bearing element is configured separately from the toilet bowl, in a step prior to the first step, the bearing element is connected to the toilet bowl.

Further embodiments are specified in the dependent claims.

BRIEF DESCRIPTION OF THE DRAWINGS

Preferred embodiments of the invention are described below with reference to the drawings, which serve merely for elucidation and are not to be interpreted as limiting. In the drawings.

DESCRIPTION OF PREFERRED EMBODIMENTS

Figure 1:
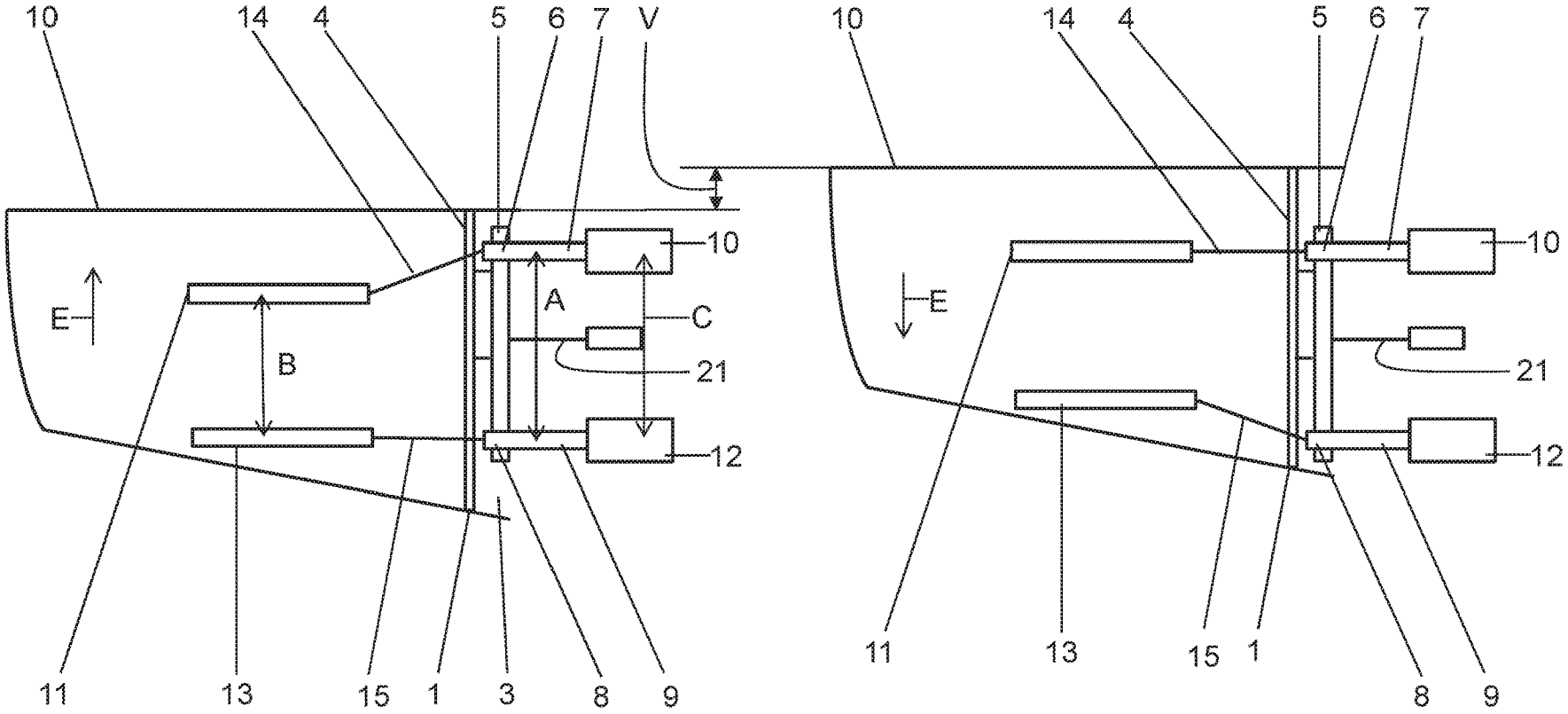
FIG. 1 shows a schematic illustration of the connection device according to one embodiment of the present invention.

FIG. 1 shows a connection device 1 for a toilet bowl 2 in a schematic manner. The connection device 1 substantially comprises a bearing element 4 and a carrier arrangement 5. The bearing element 4 can is optional and can also be omitted in other embodiments. Subsequently, the figures with the bearing element 4 are explained in greater detail.

The bearing element 4 is fixedly arranged in a receiving space 3 of the toilet bowl 2 and is fixedly connected to the toilet bowl 2. Preferably, the bearing element 4 is braced, in the receiving space 3, against the inner walls of the receiving space 3.

The carrier arrangement 5 comprises a first bearing point 6 in which a flushing pipe 7 is mounted, and a second bearing point 8 in which an outflow pipe 9 is mounted. Flushing water can be supplied to the toilet bowl 2 by way of the flushing pipe 7, and waste water is conducted away from the toilet bowl 2 by way of the outflow pipe 9. In the assembled state, the flushing pipe 7 is connected to a flushing water line 10 which is arranged in a positionally fixed manner on site, and is connected, on the toilet bowl side, to the flushing water inflow 11 of the toilet bowl 2. The flushing water inflow 11 is part of the toilet bowl 2. By way of the flushing water inflow 11, the flushing water is supplied from the flushing water line 10 to the toilet bowl 2. In the assembled state, the outflow pipe 9 is connected to a waste water line 12 which is arranged in a positionally fixed manner on site, and is connected, on the toilet bowl side, to a waste water outflow 13. The axial distance A between the center axis M7 of the flushing pipe 7 and the center axis M9 of the outflow pipe 9 is fixed or constant in the carrier arrangement 5. The axial distance corresponds to the axial distance between the flushing water line 10 and the waste water line 12. That is to say, the two bearing points 6, 8 are fixedly arranged on the carrier arrangement 5. Likewise, the elements arranged on site, namely the flushing water line 10 and the waste water line 12, are at a fixed distance with respect to one another. In addition, the flushing water inflow 11 and the waste water outflow 13 of the toilet bowl 2 are also at a fixed distance with respect to one another. Preferably, the axial distance A between the two bearing points 6, 8 is greater than the axial distance B between the flushing water inflow 11 which is arranged on the toilet side and the waste water outflow 13 which is arranged on the toilet side. The difference between the two axial distances A, B preferably corresponds to the maximum adjustment offset V. The axial distance C between the flushing water line 10 and the waste water line 12 substantially corresponds to the axial distance A.

The carrier arrangement 5 can be fixedly connected to an on-site fastening element 21. The on-site fastening element 21 is likewise arranged in a positionally fixed manner and is at a fixed distance with respect to the flushing water line 10 and the waste water line 12.

The carrier arrangement 5 and the bearing element 4, during the adjustment of the height position of the toilet bowl 2, can be displaced relative to one another in the direction of an adjustment movement E. In this case, the bearing element 4, which is fixedly connected to the toilet bowl 2, is displaced with the toilet bowl 2 relative to the positionally fixed carrier arrangement 5. This can be readily recognized in the two depictions in FIG. 1.

Further, the flushing pipe 7 and the outflow pipe 9 each comprise at least one compensation portion 14, 15, with which an adjustment offset V, which results during the adjustment movement E between the carrier arrangement 5 and the bearing element 4, between the flushing pipe 7 which is mounted in the carrier arrangement and the outflow pipe 9 which is mounted in the carrier arrangement and the flushing water inflow 11 and waste water outflow 13, respectively, which are arranged on the toilet bowl side, can be compensated. Additionally or alternatively, the adjustment offset between the flushing water line 10 and waste water line 12, respectively, which are arranged in a positionally fixed manner on site, and the flushing water inflow 11 and waste water outflow 13, respectively, which are fixedly arranged on the toilet side, can be compensatable. The adjustment offset V is illustrated in FIG. 1 as a height difference between the two toilet bowls 2.

In the left-hand side of FIG. 1, the toilet bowl is located at a lower position, while in the right-hand side of FIG. 1, the toilet bowl lies in a higher position. In this case, it can be readily recognized that the carrier arrangement 5, together with the flushing pipe 7, the outflow pipe 9 and the fastening element 21, have remained at their original positions, while the toilet bowl 2, together with the fastening element 4 and the flushing water inflow 11 and also the waste water outflow 13, have been displaced upward. The displacement which is produced during the height adjustment has been compensated by way of the two compensation portions 14, 15. The two compensation portions 14, 15 are illustrated schematically in FIG. 1, and the degree of compensation is illustrated by the different inclination of the corresponding lines. As a result of the change in the compensation portion 14, 15, which correspondingly compensates for the height offset, it is possible to adjust the height of the toilet bowl 2 in space in a simple manner, without needing to make amendments on site or on the toilet bowl.

Figure 2:
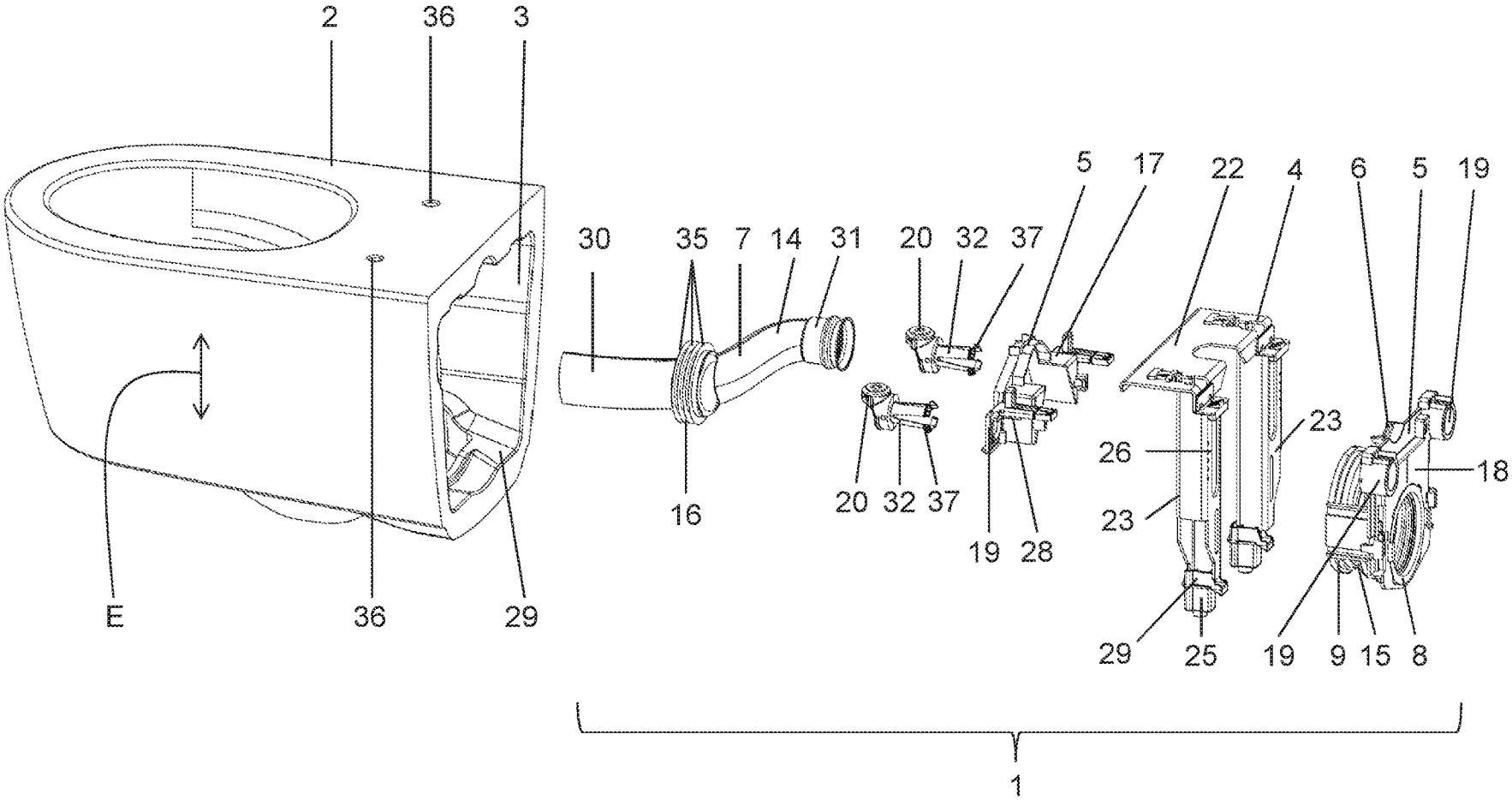
FIG. 2 shows an exploded illustration of the connection device with a toilet bowl according to the present invention.

FIG. 2 shows an exploded illustration of the toilet bowl 2 and of the connection device 1. The connection device 1, which is illustrated deconstructed into its individual parts, lies in a receiving space 3 of the toilet bowl 2. The receiving space 3 is accessible from behind by way of an access opening 29, and the individual elements of the connection device 1 can be inserted by way of the access opening 29.

Figure 3:
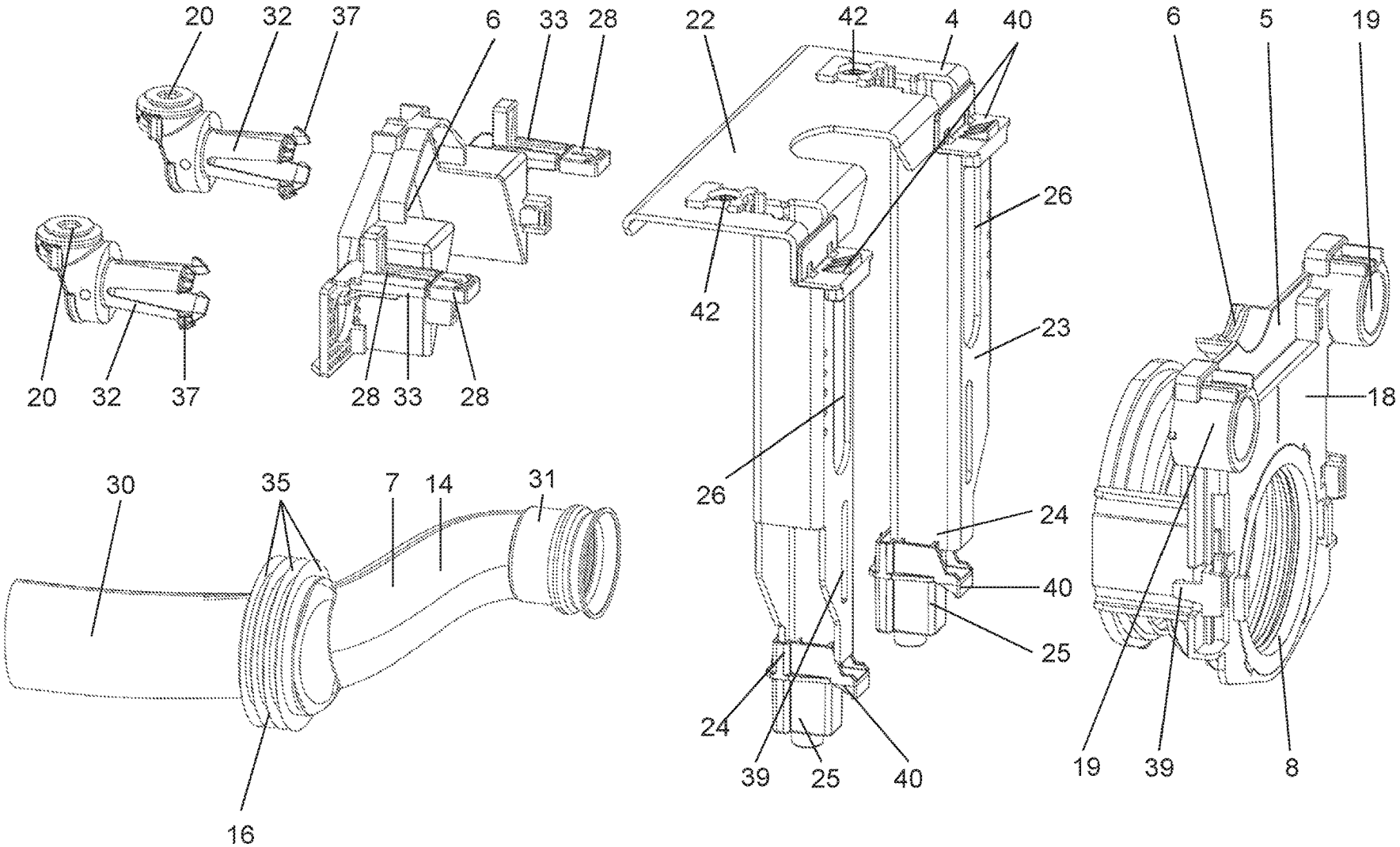
FIG. 3 shows a detail view of FIG. 2.

FIG. 3 shows a further exploded illustration of the individual parts of the connection device 1. On the basis of said illustration, the basic construction of the embodiment of the connection device 1 shown here is now explained in greater detail.

In the embodiment shown, the bearing element 4 comprises a crossmember portion 22 and two mutually spaced-apart support portions 23 which project away from the crossmember portion 22. Preferably, the crossmember portion 22 and the support portion 23 are connected-together metal profiles. At the end side, the support portions 23, in the region of their free ends 24, each have a clamping element 25. The bearing element 4 can be braced in the receiving space 3 with the clamping element 25. The crossmember portion 22 abuts at the top side in the receiving space 3 and, at the bottom side, the fastening element 4 stands, with the clamping element 25, in the interior of the receiving space 3 against the toilet bowl 2.

In the preferred embodiment, the carrier arrangement 5 is of substantially two-part configuration. The carrier arrangement 5 comprises a first carrier part 17 and a second carrier part 18 which can be connected to the first carrier part 17.

Here, the bearing point 6 for the flushing pipe 7 is provided by the first carrier part 17 and the second carrier part 18 together. The flushing pipe 7 is held between the two carrier parts 17, 18. The upper part of the bearing point 6 lies on the first carrier part 17 and the lower part of the bearing point lies on the second carrier part 18. Further, the bearing point 8 for the outflow pipe 9 is arranged on the second carrier part 18. As seen from the access opening 29, the first carrier part 17 lies substantially downstream of the bearing element 4 and the second carrier part 18 lies substantially upstream of the bearing element 4. The two-part configuration of the carrier arrangement 5 has the advantage that the latter can be assembled in a simpler manner on the bearing element 4 which is already assembled in the receiving space 3.

The carrier arrangement 5 comprises, here on the first carrier part 17 and on the second carrier part 18, a fastening receptacle 19. A threaded element 20 can be placed in the fastening receptacle 19. With the threaded element 20, the carrier arrangement 5 can be connected to the fastening element 21 which is assembled in a positionally fixed manner on site and which is typically a threaded rod. The threaded rod 21 is illustrated schematically in FIG. claim 1. As a result of an actuation of the threaded element 20 which lies in the carrier arrangement 5, the connection device 1, together with the toilet bowl 2, can be tightened against the wall. The threaded element 20 can be actuated with a tool, which is guided to the threaded element 20 through the two access openings 36 in the toilet bowl 2. To this end, the crossmember portion also has corresponding access openings, which also bear the reference sign 36.

In the embodiment shown, the threaded element 20 holds together the first carrier part 17 and the second carrier part 18. For this purpose, the threaded element 20 has a corresponding clamping portion 32, which extends through the fastening receptacle 19 on the first carrier part 17 and through the fastening receptacle 19 and second carrier part 18. In this case, the clamping portion 32 has, at the end side, a stop 37 which holds the two carrier parts 17, 18 on the clamping portion 32. The clamping portion 32 here comprises outwardly sprung tabs.

In the embodiment shown, the two support portions 23 furthermore each have a longitudinal guide 26 in which the carrier arrangement 5 is mounted in a movable manner. The carrier arrangement 5 is in this case mounted such that it can be moved relative to the bearing element 4. After the adjustment of the height has been completed, the carrier arrangement 5 and the bearing element 4 can be fixedly connected to one another. The bearing element 4, with the toilet bowl 2 at the desired height, can be fixedly secured to the carrier arrangement 5 which is positionally fixed in space.

Figure 7:
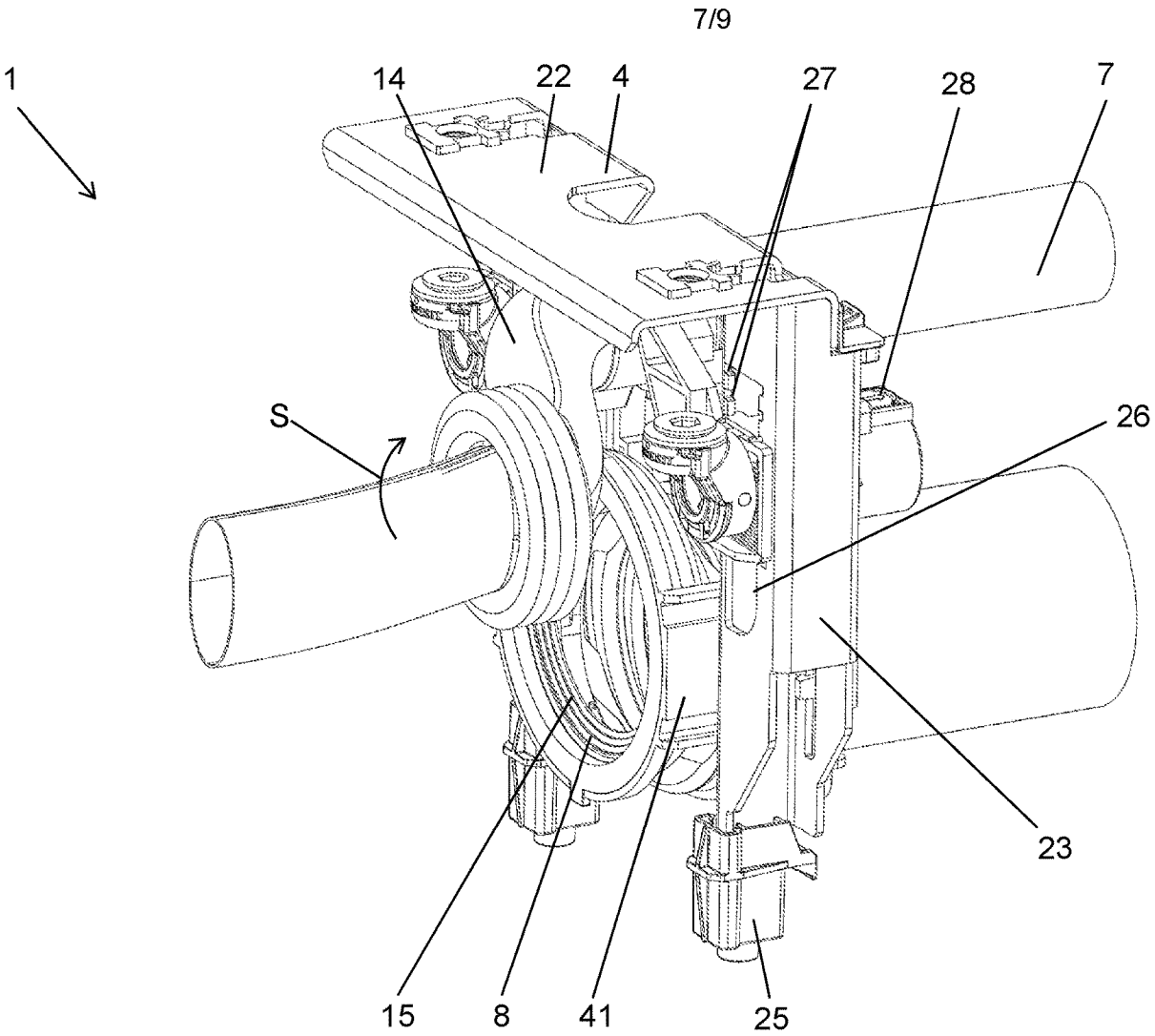
FIG. 7 shows a further detail view of the connection device according to the preceding figures.

Preferably, the connection between the bearing element 4 and the carrier arrangement 5 is of positively locking and/or force-fitting and/or frictionally locking type. In the embodiment shown, a positively locking variant is shown. Various latching openings 27, which are shown in FIG. 7, are arranged in the longitudinal guides 26. Latching elements 28 are arranged on the carrier arrangement 5, said latching elements being displaceable in such a way that the latching elements can be inserted into the latching openings 27 when the desired height has been adjusted. Here, in the region of the second carrier part 18, the latching elements 28 are arranged on the second carrier part 18 and can be displaced in such a way that the latching elements 28 engage into the latching opening 27.

In the embodiment shown, the second carrier part 18 also has a receptacle for a guide 33. The latching element 28 is mounted in the guide 33 in a movable manner. The guide 33 further engages into a receptacle 34 on the second carrier part 18. The connection between the guide 33 of the first carrier part 17 and the receptacle 34 of the second carrier part 18 furthermore provides an improved and, in particular, stable connection between the first carrier part 17 and the second carrier part 18.

The compensation portion 14 in the flushing pipe is provided by a deflecting portion 14 in the flushing pipe 7. The deflecting portion 14 here lies between a mouth portion 30 and a bearing portion 31. With the bearing portion 31, the flushing pipe 7 is mounted in the first bearing point 6 in a pivotable manner. In the direction of the flushing water inflow 11, the bearing portion 31 is adjoined by the deflecting portion 14, which is then followed by the mouth portion 30. The bearing portion 31 is connected to the flushing water line 10, and the mouth portion 30 opens into the flushing water inflow 11. The mouth portion 30 and the bearing portion 31 extend along parallel center axes. If the flushing pipe 7, in its bearing point 6, is then pivoted about the center axis, the position, in particular the height, of the mouth portion 30 changes, as a result of which the height offset can be correspondingly compensated.

On account of the pivoting movement, the mouth portion 30 is moved along a curved line. The pivoting movement is illustrated in the figures with the reference sign S. Said movement leads to a transverse offset of the mouth portion 30 in the flushing water inflow 11 in the toilet bowl 2. Said transverse offset is correspondingly compensated by the seal 16. The seal 16 is an elastic, in particular a highly elastic, seal which, in the embodiment shown, has a plurality of sealing lips 35 which are in contact with the walls of the flushing water inflow 11. During the adjustment of the height, said sealing lips 35 are then deformed elastically, in accordance with their eccentricity, toward the flushing water inflow 11. The flushing pipe 7 is preferably of rigid configuration and does not comprise a flexible portion. This has the advantage that no losses in terms of flow occur as a result of an undesired deformation of the flushing pipe 7 occurring during assembly. The mouth portion 30 of the flushing pipe is also of comparatively long configuration, such that the flushing pipe 7 can protrude as deeply as possible into the mouth portion 30, as a result of which the losses in terms of flow can be correspondingly predicted.

Figure 9:
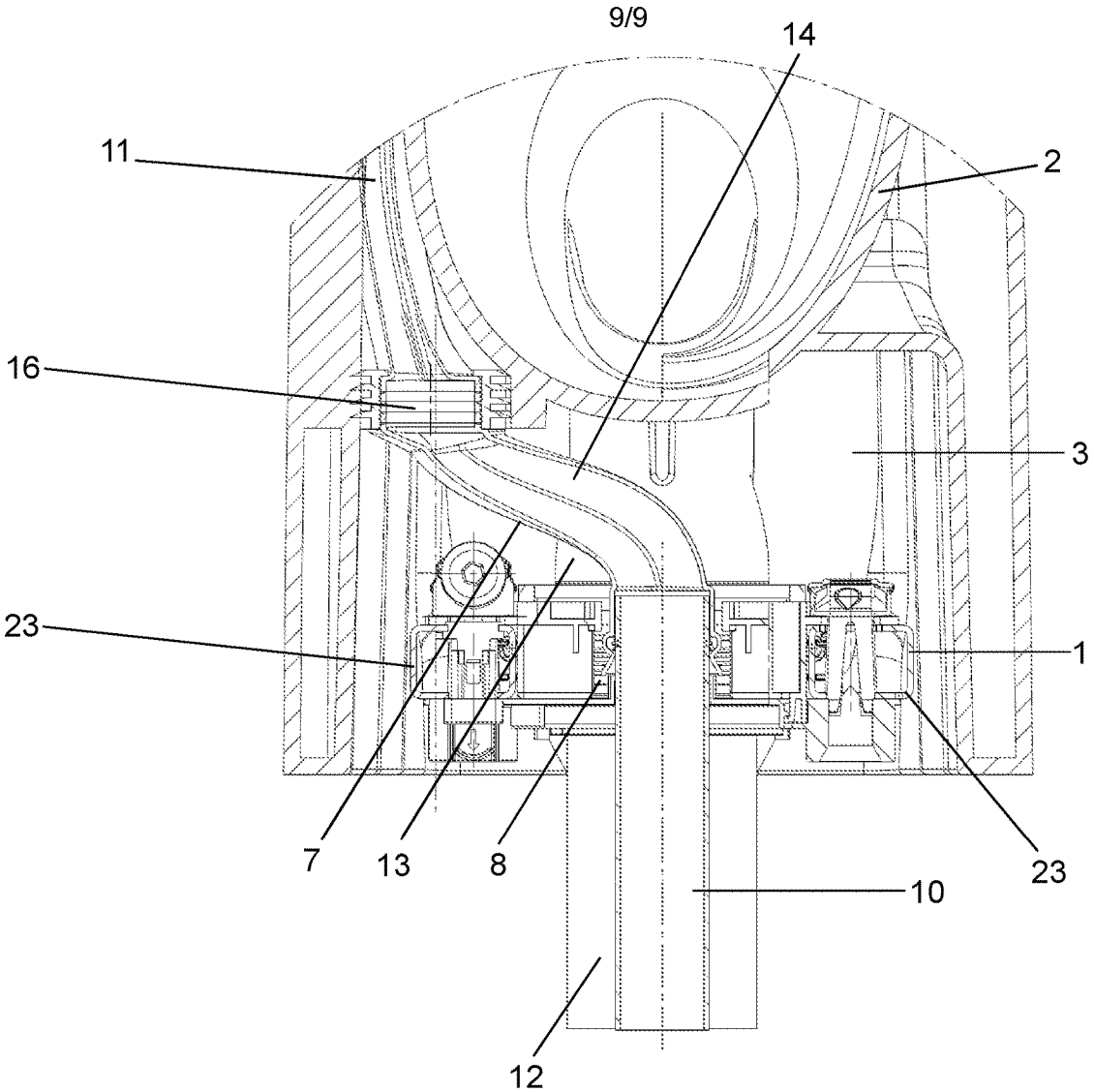
FIG. 9 shows a further sectional illustration of the toilet bowl with the connection device.

FIG. 9 shows how the flushing pipe 7 protrudes, with the mouth portion 30, into the flushing water inflow 11 and how the seal 16 is in contact, with the sealing lips 35, with the wall of the flushing water inflow 11. In addition, FIG. 9 shows that the bearing portion 31 is in contact with the flushing water line 10.

Figure 4:
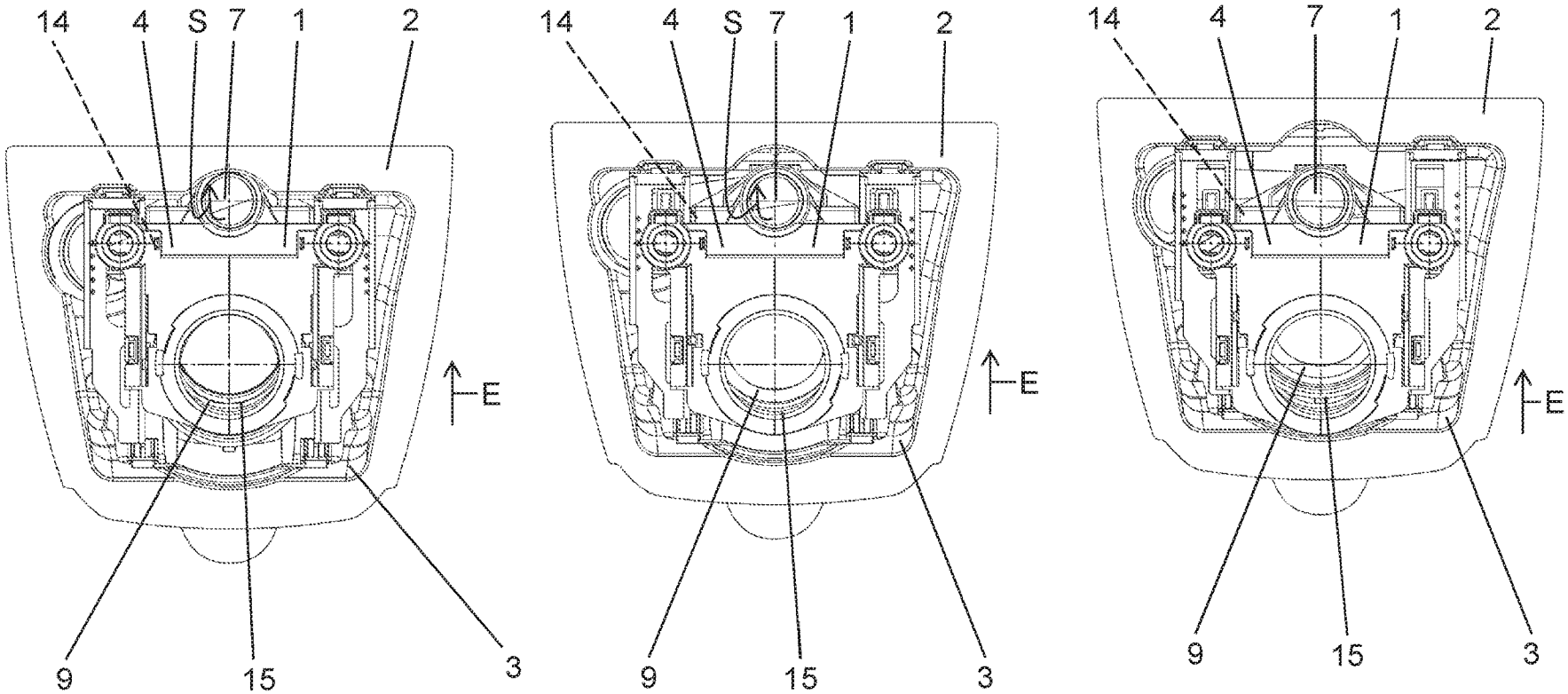
FIGS. 4/5 show rear views and perspective views of the preceding figures, respectively, with the toilet bowl in each case being placed at a different height position.

The compensation portion 15 on the outflow pipe 9 is provided by a flexible deformable pipe portion. In the embodiment shown, said pipe portion is a flexible corrugated bellows, or a rubber bellows. From FIG. 4, it is readily possible to recognize how the corrugated bellows, or the rubber bellows, is changed in terms of its shape during the height adjustment. In addition, in FIG. 4, it is likewise readily possible to recognize how the flushing pipe 7 is pivoted about its center axis in the region of the first bearing point 6 during the height adjustment. The outflow pipe 9 is fixedly held in the second bearing point 8.

Figure 5:
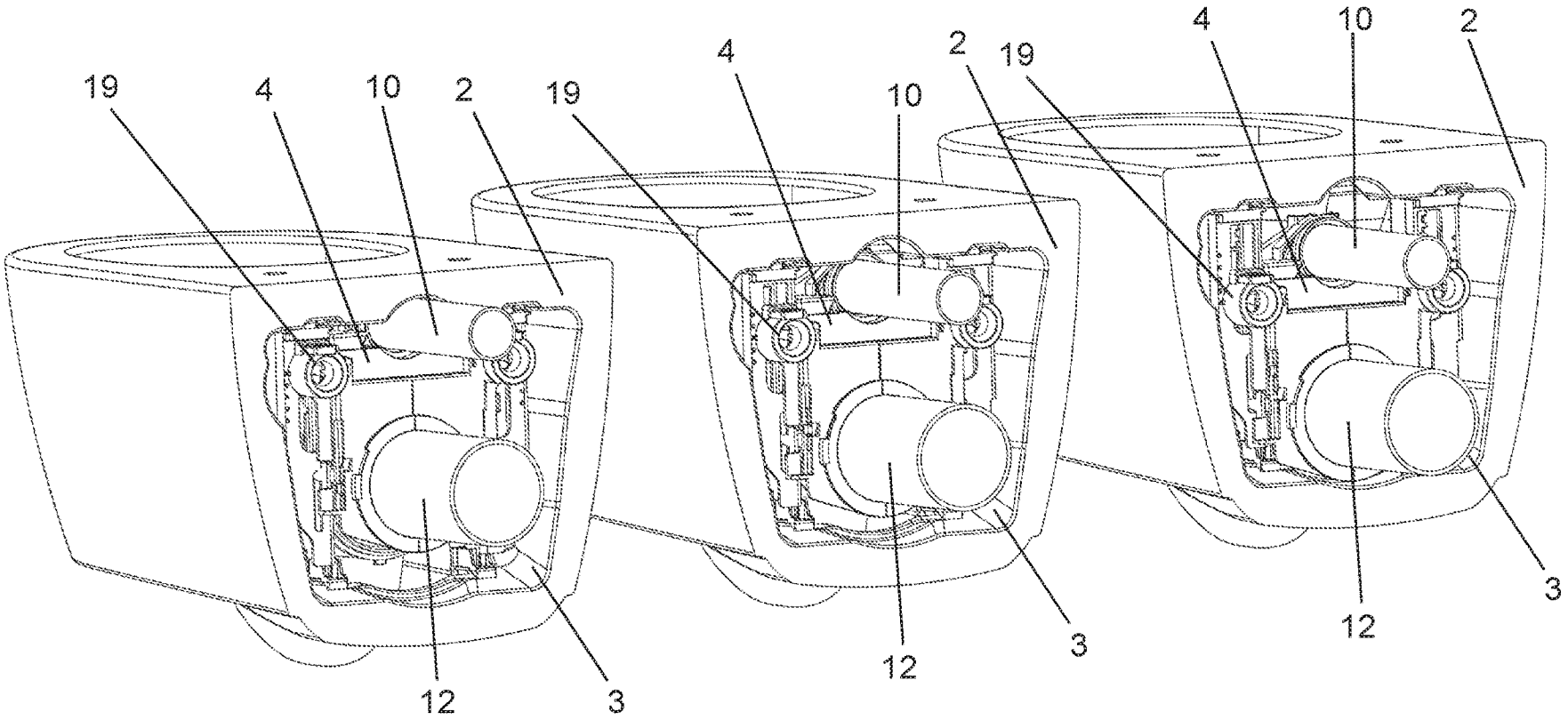

FIG. 5 then shows further perspective views of the connection device 1, together with the toilet bowl 2, in various height positions.

Figure 6:
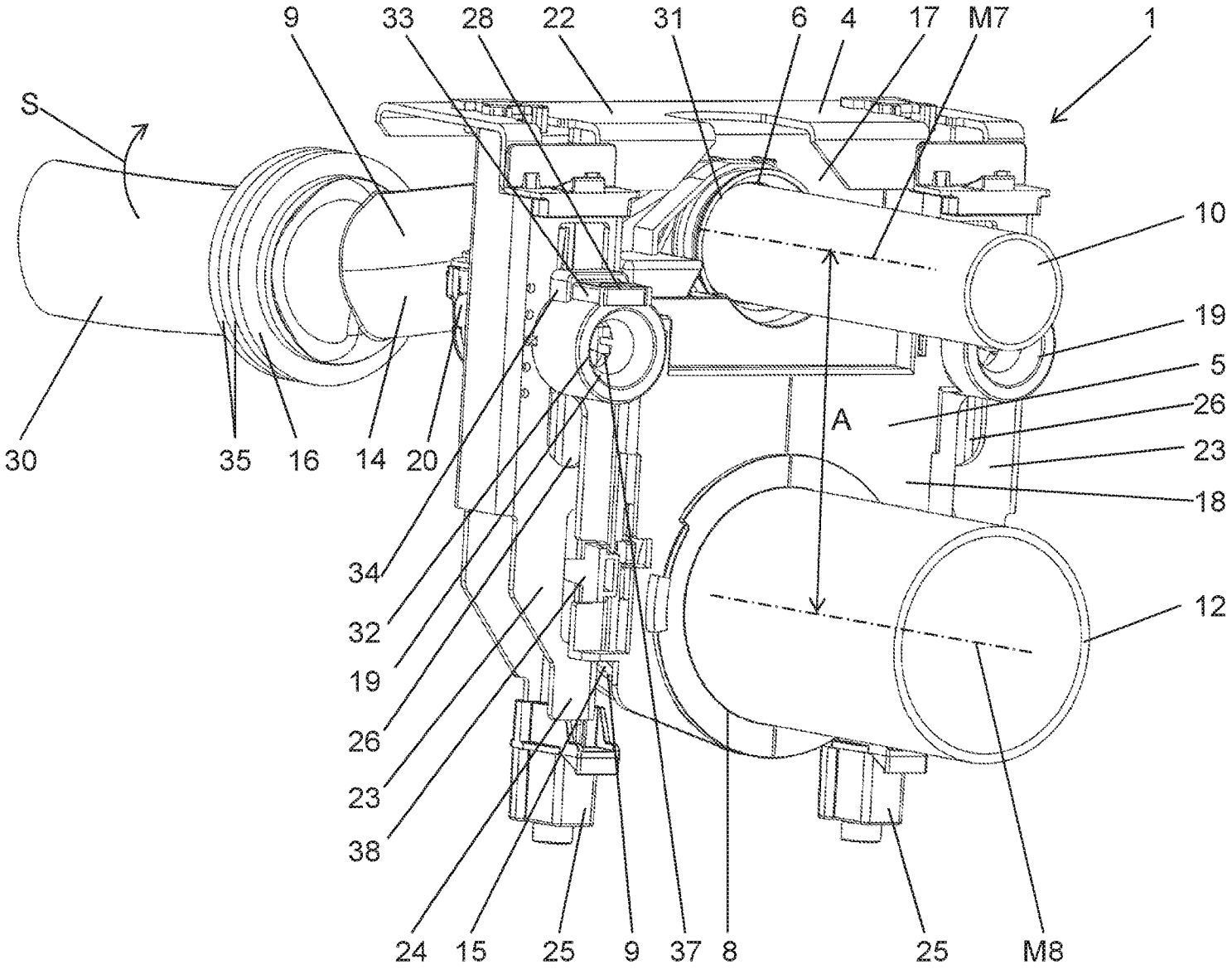
FIG. 6 shows a detail view of the connection device according to the preceding figures.
Figure 8:
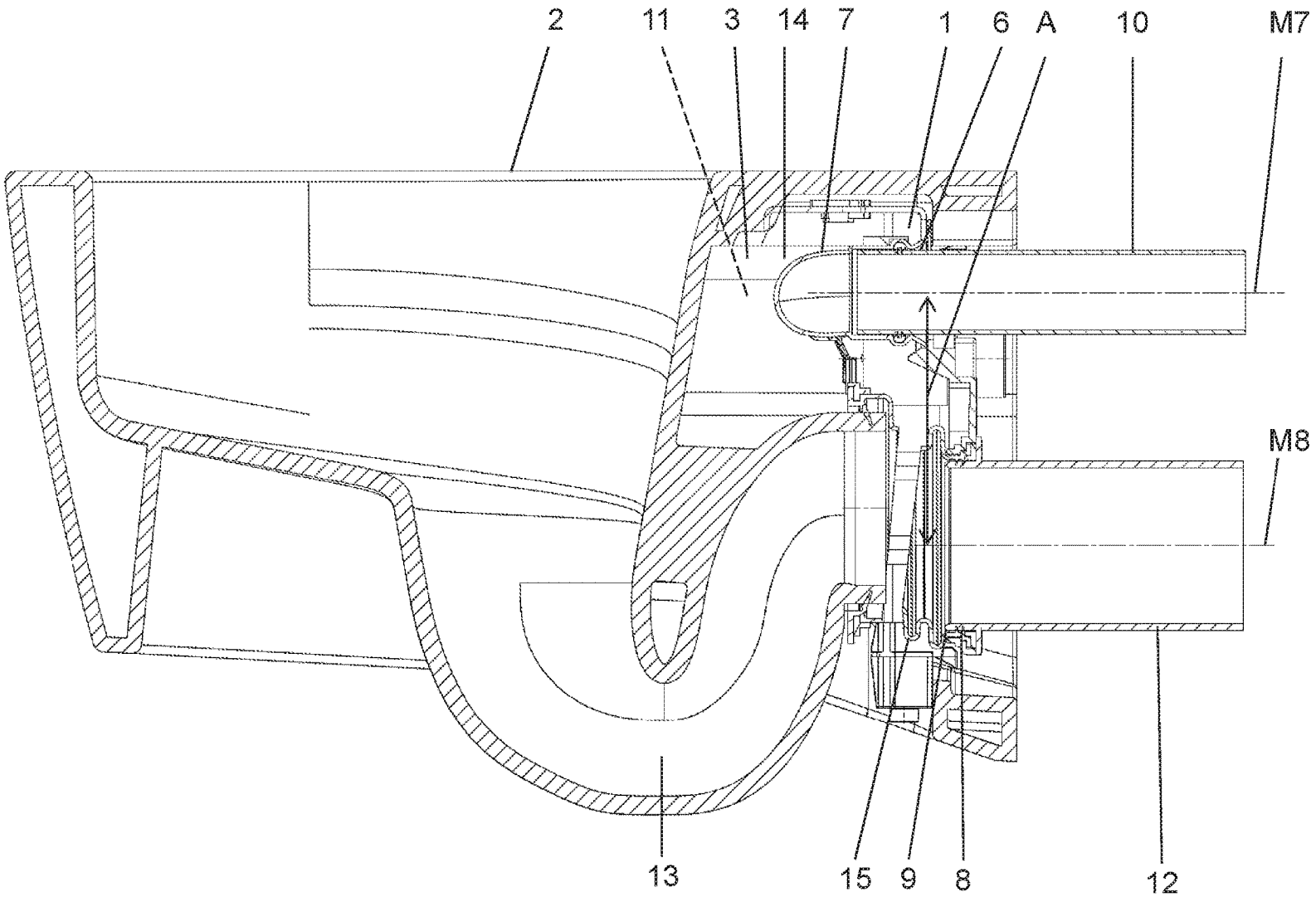
FIG. 8 shows a sectional illustration of the toilet bowl with the connection device.

FIG. 6 shows a rear view of the assembled connection device 1. The carrier arrangement 5 further comprises snap-fit elements 38, which engage into a groove 39 on the carrier arrangement 5. The groove 39 is in this case oriented in the same direction as the longitudinal guides 26, and the snap-fit elements 38 can be displaced in the groove during the height adjustment. Further, FIG. 6 shows an upper shoulder 40 on the crossmember portion 22 and a lower shoulder 40 on the clamping element 25. By way of said two shoulders, the bearing element 4 can be clamped in the receiving space 3. From FIG. 8, it is readily possible to recognize that the clamping element 25 can be actuated through an access 42.

FIG. 7 then shows a front view of the assembled connection device 1 in greater detail. A respective guide tab 41 is arranged laterally with respect to the compensation portion 15 of the outflow pipe 9, said guide tab preventing the compensation portion 15 from deflecting laterally with respect to the direction of movement of the height adjustment.

LIST OF REFERENCE SIGNS

| | |
|---|---|
| 1 | Connection device |
| 2 | Toilet bowl |
| 3 | Receiving space |
| 4 | Bearing element |
| 5 | Carrier arrangement |
| 6 | First bearing point |
| 7 | Flushing pipe |
| 8 | Second bearing point |
| 9 | Outflow pipe |
| 10 | Flushing water line |
| 11 | Flushing water inflow |
| 12 | Waste water line |
| 13 | Waste water outflow |
| 14 | Compensation portion |
| 15 | Compensation portion |
| 16 | Seal |
| 17 | First carrier part |
| 18 | Second carrier part |
| 19 | Fastening receptacle |
| 20 | Threaded element |
| 21 | Fastening element, threaded rod |
| 22 | Crossmember portion |
| 23 | Support portion |
| 24 | Free end |
| 25 | Clamping element |
| 26 | Longitudinal guide |
| 27 | Latching openings |
| 28 | Latching element |
| 29 | Access opening |

-continued

LIST OF REFERENCE SIGNS

| | |
|---|---|
| 30 | Mouth portion |
| 31 | Bearing portion |
| 32 | Clamping portion |
| 33 | Guide |
| 34 | Receptacle |
| 35 | Sealing lips |
| 36 | Access openings |
| 37 | Stop |
| 38 | Snap-fit elements |
| 39 | Groove |
| 40 | Upper and lower shoulder |
| 41 | Guide tab |
| 42 | Access |
| A | Axial distance |
| B | Axial distance (toilet side) |
| E | Adjustment movement |
| V | Adjustment offset |
| M7 | Flushing pipe center axis |
| M8 | Outflow pipe center axis |

The invention claimed is:

1. A connection device for a toilet bowl, comprising a carrier arrangement which can be connected to the toilet bowl in a displaceable manner, having a first bearing point in which a flushing pipe is mounted, and having a second bearing point in which an outflow pipe is mounted, wherein said flushing pipe can be connected to a flushing water line which is arranged in a positionally fixed manner on site, and can be connected to a flushing water inflow which is arranged on the toilet bowl side, wherein said outflow pipe can be connected to a waste water line which is arranged in a positionally fixed manner on site, and can be connected to a waste water outflow which is arranged on the toilet bowl side, wherein the axial distance between the center axis of the flushing pipe and the center axis of the outflow pipe is fixed in the carrier arrangement, wherein the carrier arrangement and the toilet bowl, during the adjustment of the height position of the toilet bowl, can be displaced relative to one another in the direction of an adjustment movement, and wherein the flushing pipe and the outflow pipe each have at least one compensation portion, with which an adjustment offset, which results during the adjustment movement between the carrier arrangement and the toilet bowl, between the flushing pipe which is mounted in the carrier arrangement and the outflow pipe which is mounted in the carrier arrangement and the flushing water inflow and waste water outflow, respectively, which are arranged on the toilet bowl side, and/or between the flushing water line which is arranged in a positionally fixed manner on site and the waste water line which is arranged in a positionally fixed manner on site and the flushing water inflow and waste water outflow, respectively, which are arranged on the toilet bowl side, can be compensated.

2. The connection device as claimed in claim 1, wherein the carrier arrangement can be arranged within a receiving space of the toilet bowl; and/or wherein the at least one compensation portion lies within the receiving space of the toilet bowl; and/or wherein the compensation portion lies between the carrier arrangement and the flushing water inflow and the waste water outflow, respectively.

3. The connection device as claimed in claim 1, wherein the axial distance between the two bearing points is greater than the axial distance between the flushing water inflow which is arranged on the toilet side and the waste water outflow which is arranged on the toilet side, and wherein the difference between the two axial distances corresponds to the maximum adjustment offset.

4. The connection device as claimed in claim 1, wherein the compensation portion in the flushing pipe and/or in the outflow pipe is provided by a deflecting portion in the respective pipe and by a pivotable mounting of the respective pipe in the bearing point, and wherein, during the height adjustment, the respective pipe is pivoted in the bearing point.

5. The connection device as claimed in claim 4, wherein, in the region of the inlet into the flushing water inflow and into the waste water outflow, respectively, the flushing pipe and the outflow pipe, respectively, are mounted with a seal in the flushing water inflow and in the waste water outflow, respectively, which seal is configured in such a way that a displacement of the respective pipe transversely with respect to the center axis of the flushing water inflow and of the waste water outflow, respectively, can be accommodated.

6. The connection device as claimed in claim 4, wherein the carrier arrangement has at least one fastening receptacle, in which at least one fastening receptacle a threaded element can be placed, wherein the threaded element can be brought into engagement with a threaded rod which is assembled on site, and/or wherein the toilet bowl and/or the carrier arrangement can be connected in a mechanically fixed manner to a fastening element which is fixedly arranged on site.

7. The connection device as claimed in claim 4, wherein the carrier arrangement comprises a first carrier part and a second carrier part which can be connected to the first carrier part, wherein the bearing point for the flushing pipe is preferably provided by the first carrier part and the second carrier part, and wherein the bearing point for the outflow pipe is preferably arranged on the second carrier part.

8. The connection device as claimed in claim 4, wherein a bearing element can be fixedly connected to the toilet bowl or is integrated on the toilet bowl or is provided by the toilet bowl, and wherein the carrier arrangement is movably connected to the bearing element in such a way that said adjustment movement can be executed.

9. The connection device as claimed in claim 8, wherein the carrier arrangement and the bearing element are connected to one another by way of at least one longitudinal guide, and wherein the at least one longitudinal guide is oriented in the vertical in the installation position.

10. The connection device as claimed in claim 8, wherein, as seen from the access opening of the receiving space into the receiving space, the first carrier part lies substantially downstream of the bearing element, and wherein the second carrier part lies substantially upstream of the bearing element.

11. The connection device as claimed in claim 8, wherein, after adjustment of the height position has been completed, the carrier arrangement can be fixed to the bearing element, or can be connected to the bearing element, in a positively locking and/or force-fitting and/or frictionally locking manner.

12. The connection device as claimed in claim 8, wherein the bearing element has a crossmember portion and two mutually spaced-apart support portions which project away from the crossmember portion, wherein the support portions, in the region of their free end, each have a clamping element, with which the bearing element can be braced in the receiving space.

13. The connection device as claimed in claim 12, wherein the support portions have a longitudinal guide in which the carrier arrangement is mounted in a movable manner, wherein, after adjustment has been completed, the carrier arrangement can be fixed, or can be connected, to the support portions in a positively locking and/or force-fitting and/or frictionally locking manner.

14. The connection device as claimed in claim 12, wherein the support portions have a longitudinal guide in which the carrier arrangement is mounted in a movable manner, wherein, after adjustment has been completed, the carrier arrangement can be fixed, or can be connected, to the support portions in a positively locking, and wherein for said positively locking the longitudinal guide has mutually spaced-apart latching openings into which a latching element which is arranged on the carrier arrangement can engage in said positively locking manner.

15. The connection device as claimed in claim 1, wherein the compensation portion in the outflow pipe and/or in the flushing pipe is a flexibly deformable pipe portion, which flexible deformable pipe portion is preferably a corrugated bellows or a rubber bellows.

16. An arrangement comprising a toilet bowl and a connection device, said connection device comprises a carrier arrangement which can be connected to the toilet bowl in a displaceable manner, having a first bearing point in which a flushing pipe is mounted, and having a second bearing point in which an outflow pipe is mounted, wherein said flushing pipe can be connected to a flushing water line which is arranged in a positionally fixed manner on site, and can be connected to a flushing water inflow which is arranged on the toilet bowl side, and wherein said outflow pipe can be connected to a waste water line which is arranged in a positionally fixed manner on site, and can be connected to a waste water outflow which is arranged on the toilet bowl side, wherein the axial distance between the center axis of the flushing pipe and the center axis of the outflow pipe is fixed in the carrier arrangement, wherein the carrier arrangement and the toilet bowl, during the adjustment of the height position of the toilet bowl, can be displaced relative to one another in the direction of an adjustment movement, and wherein the flushing pipe and the outflow pipe each have at least one compensation portion, with which an adjustment offset, which results during the adjustment movement between the carrier arrangement and the toilet bowl, between the flushing pipe which is mounted in the carrier arrangement and the outflow pipe which is mounted in the carrier arrangement and the flushing water inflow and waste water outflow, respectively, which are arranged on the toilet bowl side, and/or between the flushing water line which is arranged in a positionally fixed manner on site and the waste water line which is arranged in a positionally fixed manner on site and the flushing water inflow and waste water outflow, respectively, which are arranged on the toilet bowl side, can be compensated.

17. A method for assembling a connection device comprising a carrier arrangement, which can be connected to the toilet bowl in a displaceable manner, having a first bearing point in which a flushing pipe is mounted, and having a second bearing point in which an outflow pipe is mounted, wherein said flushing pipe can be connected to a flushing water line which is arranged in a positionally fixed manner on site, and can be connected to a flushing water inflow which is arranged on the toilet bowl side, wherein said outflow pipe can be connected to a waste water line which is arranged in a positionally fixed manner on site, and can be connected to a waste water outflow which is arranged on the toilet bowl side, wherein the axial distance between the center axis of the flushing pipe and the center axis of the outflow pipe is fixed in the carrier arrangement, wherein the carrier arrangement and the toilet bowl, during the adjustment of the height position of the toilet bowl, can be displaced relative to one another in the direction of an adjustment movement, and wherein the flushing pipe and the outflow pipe each have at least one compensation portion, with which an adjustment offset, which results during the adjustment movement between the carrier arrangement and the toilet bowl, between the flushing pipe which is mounted in the carrier arrangement and the outflow pipe which is mounted in the carrier arrangement and the flushing water inflow and waste water outflow, respectively, which are arranged on the toilet bowl side, and/or between the flushing water line which is arranged in a positionally fixed manner on site and the waste water line which is arranged in a positionally fixed manner on site and the flushing water inflow and waste water outflow, respectively, which are arranged on the toilet bowl side, can be compensated, the method comprising:

in a first step, connecting the carrier arrangement to the toilet bowl, wherein the flushing pipe is connected to the flushing water inflow and the outflow pipe is connected to the waste water outflow;

in a second step, displacing the toilet bowl relative to the carrier arrangement, such that the height of the toilet bowl can be adjusted, wherein, in this way, the compensation portions, in accordance with the height position, compensate for the adjustment offset, which results during the adjustment movement between the carrier arrangement and the toilet bowl, between the flushing pipe which is mounted in the carrier arrangement and the outflow pipe which is mounted in the carrier arrangement and the flushing water inflow and waste water outflow, respectively, which are arranged on the toilet bowl side, and/or between the flushing water line and waste water line, respectively, which are arranged in a positionally fixed manner on site and the flushing water inflow and waste water outflow, respectively, which are arranged on the toilet bowl side, and in a third step, orienting the carrier arrangement with respect to, and connected to, the on-site flushing water line, the on-site waste water line and the on-site fastening element.

18. The method as claimed in claim 17, wherein, after adjustment of the height position has been completed, the carrier arrangement can be fixed, or can be connected, to the bearing element in a positively locking and/or force-fitting and/or frictionally locking manner; and/or wherein the carrier arrangement is fixedly connected to the fastening element.

* * * * *